US005511684A

United States Patent [19]

Weaver, Jr.

[11] Patent Number: 5,511,684

[45] Date of Patent: Apr. 30, 1996

[54] CONTAINER WITH MOVABLE BOTTOM PORTION FOR DISPENSING CONTENTS

[75] Inventor: Edmund A. Weaver, Jr., Racine, Wis.

[73] Assignee: Kraft General Foods, Inc., Northfield, Ill.

[21] Appl. No.: 296,732

[22] Filed: Aug. 26, 1994

[51] Int. Cl.[6] ..... B65D 23/00

[52] U.S. Cl. ..... 220/630; 206/505; 220/405

[58] Field of Search ..... 220/630, 625, 220/8, 402, 403, 404, 405, 258; 206/505

[56] References Cited

U.S. PATENT DOCUMENTS

| | | | |
|---|---|---|---|
| 770,215 | 10/1904 | Blatz et al. . | |
| 1,334,346 | 5/1920 | Boehm . | |
| 1,575,567 | 3/1926 | Geake . | |
| 2,152,862 | 4/1939 | Bergerioux | 221/60 |
| 2,208,744 | 7/1940 | Bergerioux | 221/60 |
| 2,270,935 | 1/1942 | Doering | 99/171 |
| 2,434,505 | 1/1948 | Miller | 222/105 |
| 2,649,995 | 8/1953 | Muskin | 222/105 |
| 2,750,294 | 6/1956 | Peters | 220/405 X |
| 2,853,209 | 9/1958 | McArdle | 222/107 |
| 3,360,162 | 12/1967 | Miles | 206/505 |
| 3,483,908 | 12/1969 | Donovan | 150/0.5 |
| 3,777,925 | 12/1973 | Eckholm | 220/404 X |
| 3,804,281 | 4/1974 | Eckdahl | 220/630 X |
| 4,244,470 | 1/1981 | Burnham | 206/525 |
| 4,394,906 | 7/1983 | Hollenbeck | 206/525 |
| 4,796,411 | 1/1989 | Kimura et al. | 53/453 |
| 4,804,102 | 2/1989 | Morris | 222/386 |
| 4,856,674 | 8/1989 | Berney | 220/258 |

*Primary Examiner*—Steven M. Pollard
*Attorney, Agent, or Firm*—Fitch, Even, Tabin & Flannery

[57] ABSTRACT

A container assembly includes a plastic tub having a flexible sidewall which allows a bottom wall of the tub to be pushed toward the tub upper end, to dislodge contents of the container assembly. An outer housing surrounds the tub sidewall and is joined to the upper end of the tub.

2 Claims, 7 Drawing Sheets

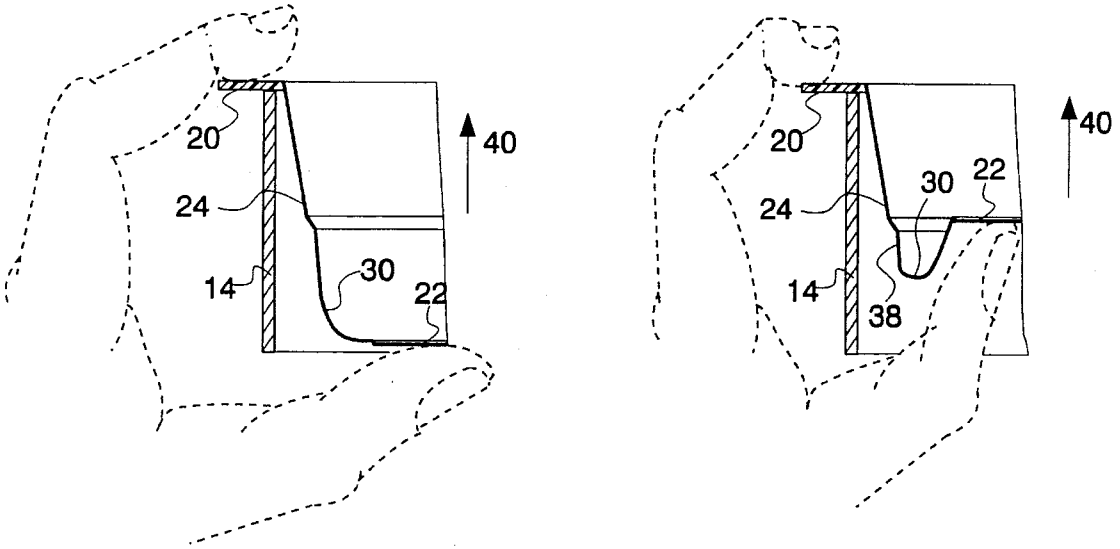
Fig. 7A
Fig. 7B
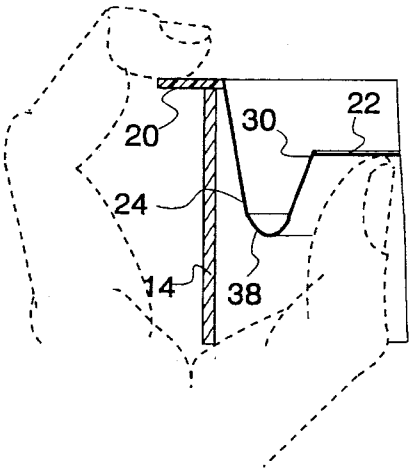
Fig. 7C

CONTAINER WITH MOVABLE BOTTOM PORTION FOR DISPENSING CONTENTS

BACKGROUND OF THE INVENTION

1. Field of the Invention

The present invention pertains to containers in the form of a sealed tub, and in particular to such containers for use with products which cannot be readily poured out of an open top container.

2. Description of the Related Art

Specialized containers have been developed for materials which are difficult to dispense if the use of external implements, such as spoons, is to be avoided. For example, ice cream confections have been produced in a cylindrical form, shipped inside cardboard tubes for delivery to consumer. When the outer wrapping is removed from the cardboard tube, a spoon could be used to withdraw the ice cream confection in the amount desired. However, specialized containers have been developed with a plastic plunger fitted to the bottom end of the tube. With operation of the plunger, a consumer can push a desired amount of ice cream confection past the top of the tube, and can continue the process in virtually any increment size desired, until the entire contents of the tube are consumed. A package of this general type has been proposed for cheese foods, as described in U.S. Pat. No. 2,270,935. The tube-and-plunger concept has also been proposed for toothpaste, shaving cream and the like, as described in U.S. Pat. No. 2,434,505.

Containers have also been proposed to provide a plunger action without requiring a separate plunger element, and examples may be found in U.S. Pat. Nos. 2,853,209 and 4,394,906.

It is sometimes desired to dispense the entire contents of a container in a single operation and U.S. Pat. No. 3,483,908 has proposed a plastic container having a flexible bottom wall which applies a displacing force to the cupcake. Further advances are still being sought in the container art, particularly for products such as food which must be carefully sealed, with the integrity of the seal being maintained until final delivery to a consumer.

SUMMARY OF THE INVENTION

It is an object of the present invention to provide a container having a plunger action, which is suitable for use with food stuffs and other materials which must be sealed until the moment of dispensing.

Another object according to principles of the present invention is to provide a container of the above-described type which is easily openable and with which the entire contents of the container may be readily removed, in tact, in a single operation.

Another object according to principles of the present invention is to provide a container of the above-described type suitable for use as a storage tub which can be opened for removal of a small amount of product. The plastic lid is snapped on to reclose for storage and future use, i.e., open and reclosed a number of times with the contents remaining fresh throughout the life of the product.

A further object according to principles of the present invention is to provide containers of the above-described type suitable for use with cheese products, such as cream cheese bricks.

These and other objects according to principles of the present invention which will become apparent from studying the appended description and drawings are provided in a container assembly, comprising:

a tub having a bottom wall and an upwardly diverging sidewall extending from the bottom wall so as to form an open top enclosure defining an interior volume for receiving contents;

a lower section of the sidewall being upwardly and slightly outwardly tapered and formed of thin flexible material so as to bend as the bottom wall is passed through the container interior to at least partially eject the contents; and an outer housing joined to the tub, and enclosing the tub sidewall, with at least lower portions of the tub being separated from the outer housing, so as to allow at least the lower end of tub sidewall to bend within the housing.

The vertical outer housing provides vertical strength and overall package unity.

BRIEF DESCRIPTION OF THE DRAWINGS

FIGS. 7A–7C show the dispensing operation of FIG. 5 in greater detail;

Figure 17:
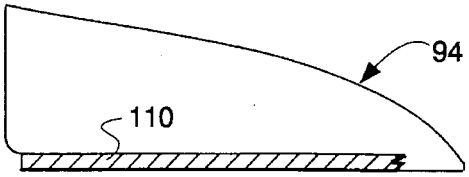
Figure 16:
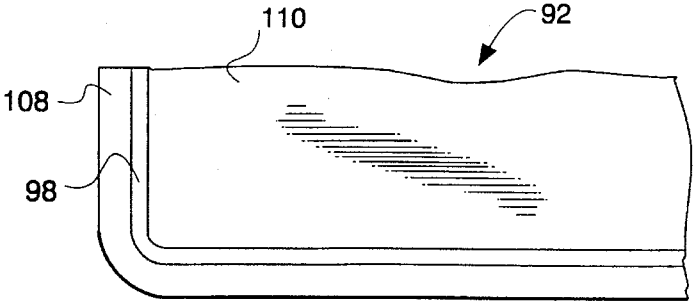
Figure 14:
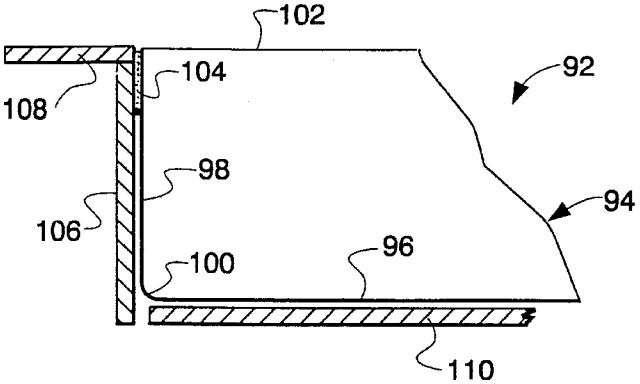
Figure 15:
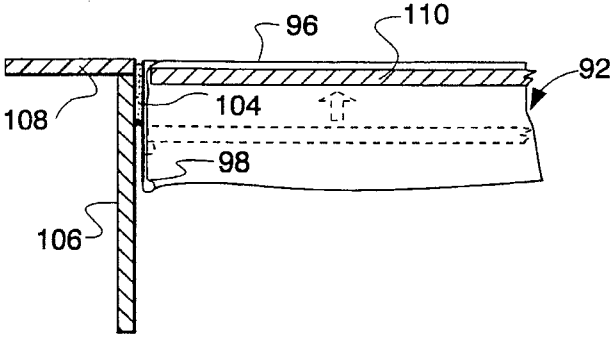

FIGS. **13*a* and 13*b*** are fragmentary cross-sectional views of an alternative container assembly;

FIG. 14 is a fragmentary cross-sectional view of a further alternative embodiment of a container assembly;

FIG. 15 shows the container assembly of FIG. 14 during a dispensing operation;

FIG. 16 is a fragmentary bottom view of the container of FIGS. 14 and 15; and FIG. 17 is a fragmentary cross-sectional view of another alternative container assembly.

DETAILED DESCRIPTION OF THE PREFERRED EMBODIMENTS

Figure 1:
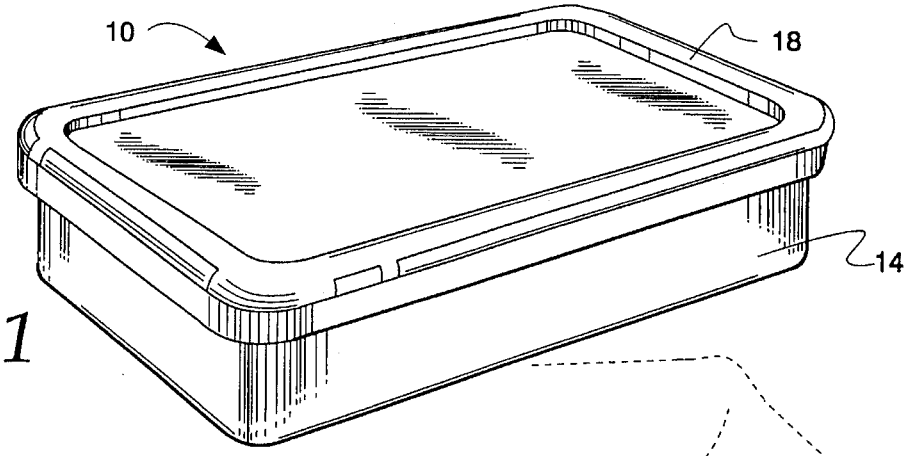
FIG. 1 is a perspective view of a sealed container, constructed according to principles of the present invention.

Turning now to the drawings, and initially to FIG. 1, a container assembly constructed according to principles of the present invention is generally indicated at 10. Construction of the container assembly is further illustrated in the exploded view of FIG. 8, and can be seen to include a tub 12, a relatively inflexible housing 14, an optional film seal 16 and an optional cover 18. The tub 12 preferably includes a flange 20 at its upper, open end, a bottom wall 22 and a continuous sidewall 24 which is upwardly and outwardly diverging. Bottom wall 22 and sidewall 24 preferably meet at a smoothly rounded outside corner 30. The tub 12 and cap 18 are preferably made of molded plastic construction, and as will be seen herein, are both made so as to be flexible in different ways. For example, in FIG. 2, cap 18 is preferably fitted for a snap-lock joinder with a flange 20 of tub 12.

Figure 2:
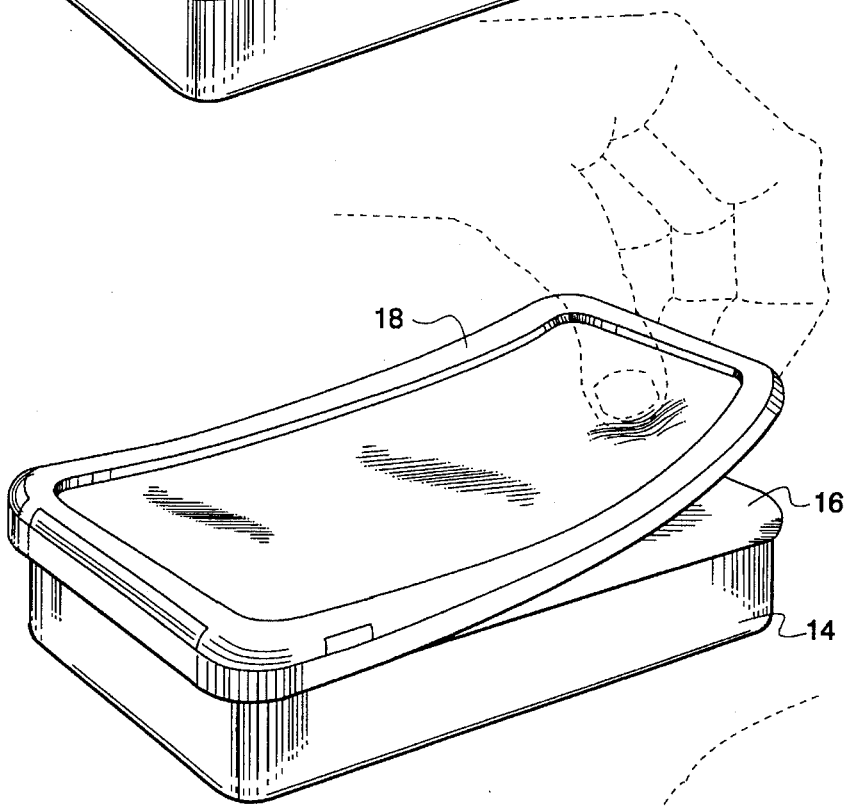
FIG. 2 is a perspective view showing a snap-on lid being removed from the package.

FIG. 2 shows the cover 18 being removed in preparation for a dispensing operation. The container assembly of the, present invention has found immediate application for use with foodstuffs, such as cheese products, and, in particular, cream cheese in brick form. However, as will be appreciated upon review of the following, the container assembly of the present invention can be used with a wide variety of products and materials including non-food items.

Figure 3:
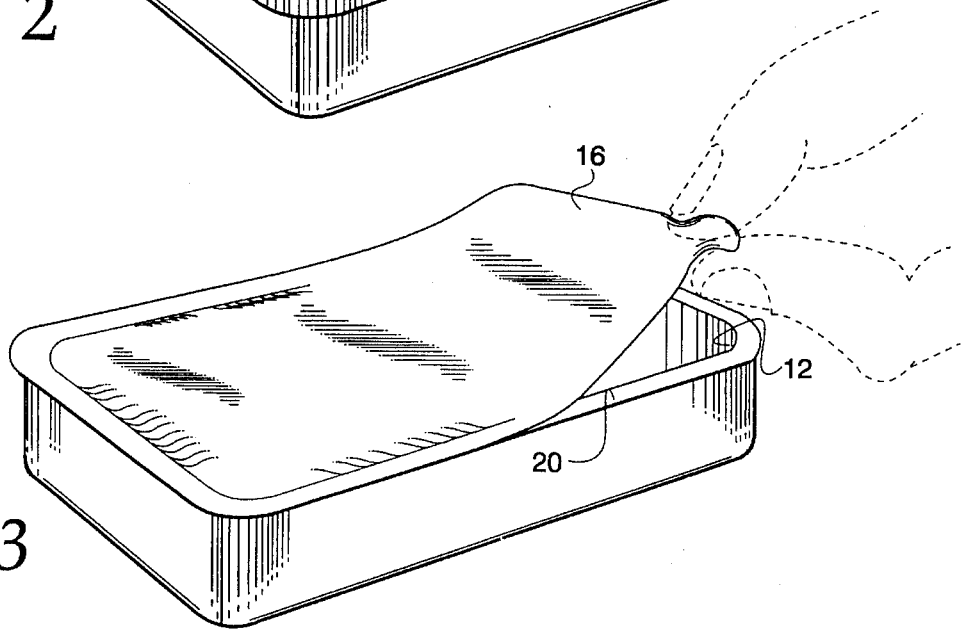
FIG. 3 shows a subsequent, optional step of opening the package, by removing a protective film disposed underneath the snap-on lid.

For many types of applications, the snap-lock cover 18 may be relied upon to provide adequate sealing of the product. However, when the container assembly is used with food products it is preferred that an optional film seal 16 be employed to close the open upper end of tub 12. FIG. 3 shows the film seal 16 being removed. The film seal is preferably joined to flange 20 with a suitable low strength adhesive or heat seal material, so as to be readily peelable away from flange 20, for opening by a user, without requiring special implements. In some applications it may be desirable to provide a stronger adhesive, thereby requiring a film seal 16 to be cut or torn in order to gain access to the container interior. This latter arrangement would for example, leave a tell-tale sign that the container has been opened.

Figure 4:
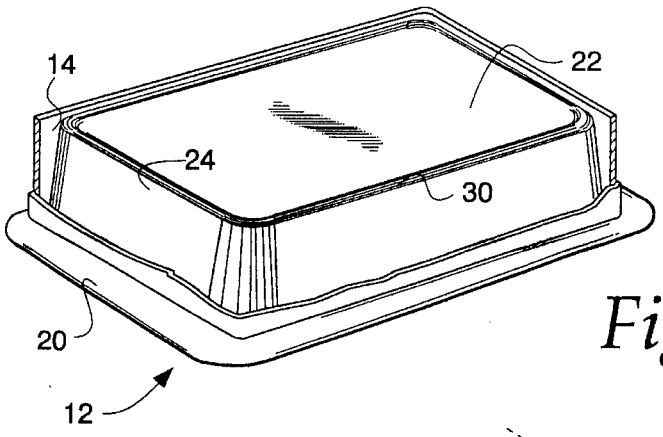
FIG. 4 shows the opened container turned upside down.

Referring now to FIG. 4, tub 12 is shown in an inverted position, preparatory to a dispensing operation. There are a wide variety of products, such as cream cheese, which adhere to the sidewall of a container. While it is possible to spoon out such contents of the tub, many users find it desirable to dispense an entire brick in a single operation. As will be seen herein, the container according to principles of the present invention provides significant advantages in these instances.

Figure 5:
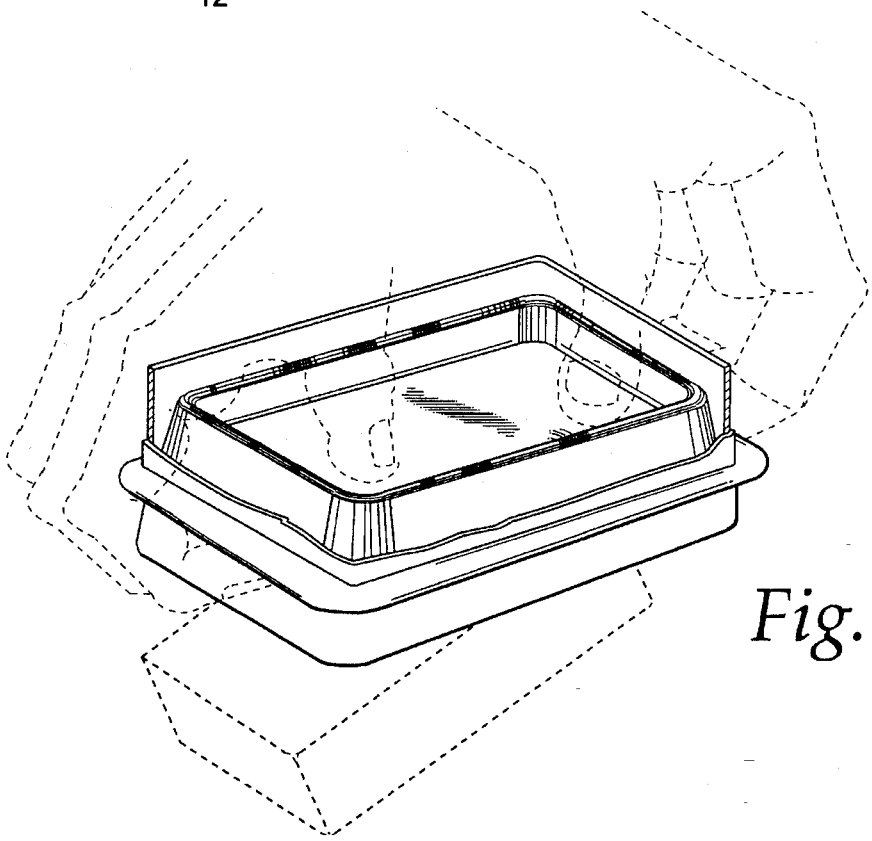
FIG. 5 shows the container during a dispensing operation.

As can be seen in FIG. 4 for example, the relatively inflexible housing 14 remains affixed to tub 12, and has a height preferably at least as great as that of tub 12. In FIG. 4, the housing 14 is shown partly cut away so as to reveal the tapered sidewall 24 of the tub, which are not attached in the lower half from housing 14. As mentioned above, the bottom wall 22 and sidewall 24 of the tub meet at a continuous rounded corner 30, which is visible in FIG. 4. The sidewall 24 is preferably made of relatively thin gage flexible plastic material so that the sidewall will form a rolling bend or fold line (see FIGS. 7A–7C) as bottom wall 22 is depressed (i.e., pushed toward flange 20) in the manner illustrated in FIG. 5.

Figure 6:
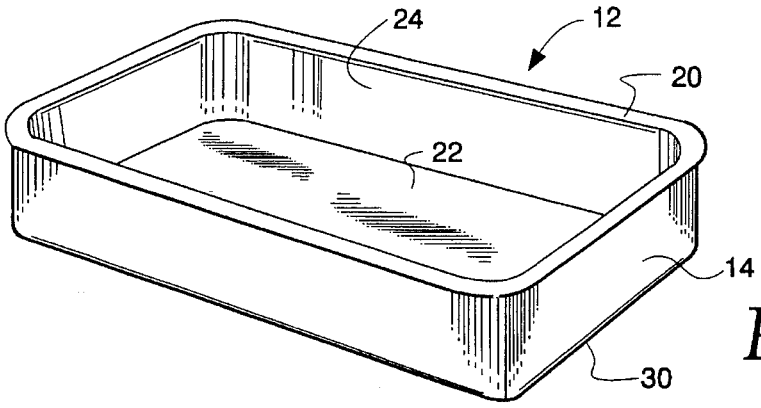
FIG. 6 shows the container after the contents are dispensed (with bottom returned to its original position)

The cream cheese brick contained in tub 12 has a familiar semi-solid consistency so as to readily fall from the inverted tub when areas of adhesion of the cream cheese brick with the tub sidewall are broken. It has been found that the push-to-release action illustrated in FIG. 5, associated with the rolling action of the sidewall when bottom wall 22 is depressed, readily releases a cream cheese brick from the plastic tub in a single operation. Further, release of the cream cheese brick has been found to be consistently reliable, without requiring any unusual degree of dexterity. Further, the container assembly according to principles of the present invention will provide a substantial advantage for consumers with reduced manual dexterity. FIG. 6 shows the empty tub after dispensing is completed and the bottom wall 22 has been moved back to its original position.

FIGS. 7A–7C detail the rolling action of sidewall 24. In these figures, the bottom wall 22, sidewall 24 and flange 20 are integrally formed as a single piece plastic molding. However, the thicknesses of the various parts of the plastic molding can be varied or the flexibility of the parts can be made to differ from each other. For example, the sidewall 24 can be made with a reduced thickness so as to readily roll to form a travelling rounded bend 38, smoothly curved in cross section, as can be seen in FIGS. 7B and 7C. It is generally preferred that the rolling bend be formed when manual pressure is applied to bottom wall 22 in the direction of arrow 40, that is, when bottom wall 22 is pushed toward flange 20. The lower portion of the tub sidewall (that portion forming the rolling bend) preferably has a height ranging between one-third to one-half the height of the tub sidewall, and most preferably, the lower portion of the tub sidewall has a height no more than one-third the height of the tub sidewall. In FIG. 7B, the bottom wall 22 is raised about one-third of the height of container 12, and in many applications, this has been found to be an adequate deflection of the bottom wall, to consistently dislodge the contents of the tub. However, as shown in FIG. 7C, the bottom wall could be depressed further, if necessary.

Referring now to FIGS. 8–12, details of construction of the container assembly will now be considered. As mentioned, it is generally preferred that the tub 12 and cover 18 be made of molded plastic material. These two components of the container assembly are preferably made of different types of plastic and have different thicknesses, although both are flexible, to some extent. The cover 18 is flexible for a snap fit of the type indicated in FIG. 2, for conventional snap lock engagement with flange 20. While tub 12 is also made of plastic material, and is also made to be flexible in desired areas, it is preferred that flexing be localized at the tub's sidewall, rather than at the tub bottom wall or the flange. Further, in those embodiments where the tub bottom wall 22 need only be raised one-third of the height of the tub, the upper two-thirds of the sidewall could be made much less flexible, since it is not required to form a rolling bend.

Housing 14 is preferably made of a paperboard material, although it could be made of a composite material, such as foil-covered paperboard or plastic-covered paperboard or plastic, if desired. Further, housing 14 could carry a printed message, as well as coupons or other removable items which are popular with consumers today. The upper end of housing 14 is preferably joined with an adhesive or heat sealed to the upper portions of the tub at the denesting lugs on the corners or on the underside of the flange 20. It is preferred that housing 14 be relatively inflexible compared to sidewall 24, so as to provide stacking strength for the assembly. Accordingly, the sidewall need not be relied on to provide stacking strength.

As mentioned above, the container assembly according to principles of the present invention has found immediate acceptance for use with cream cheese. It is desirable to protect this type of product from sunlight and certain types of artificial lighting. A cost-effective technique of producing tub 12 with a sidewall of the desired flexibility involves forming the tub with a very thin sidewall, so thin as to be translucent. While a light-blocking adhesive label could be applied to the outside of the tub, this would interfere with the rolling bend feature described above. Accordingly, manufacture of the container assembly has found it expedient to form housing 14 of a light-blocking material, sufficient to protect the contents of the container assembly, without requiring special construction of the plastic tub (either by using the aforementioned adhesive labels, or incorporating a light-blocking dye or plastic filler in the plastic composition, for example).

Figure 8:
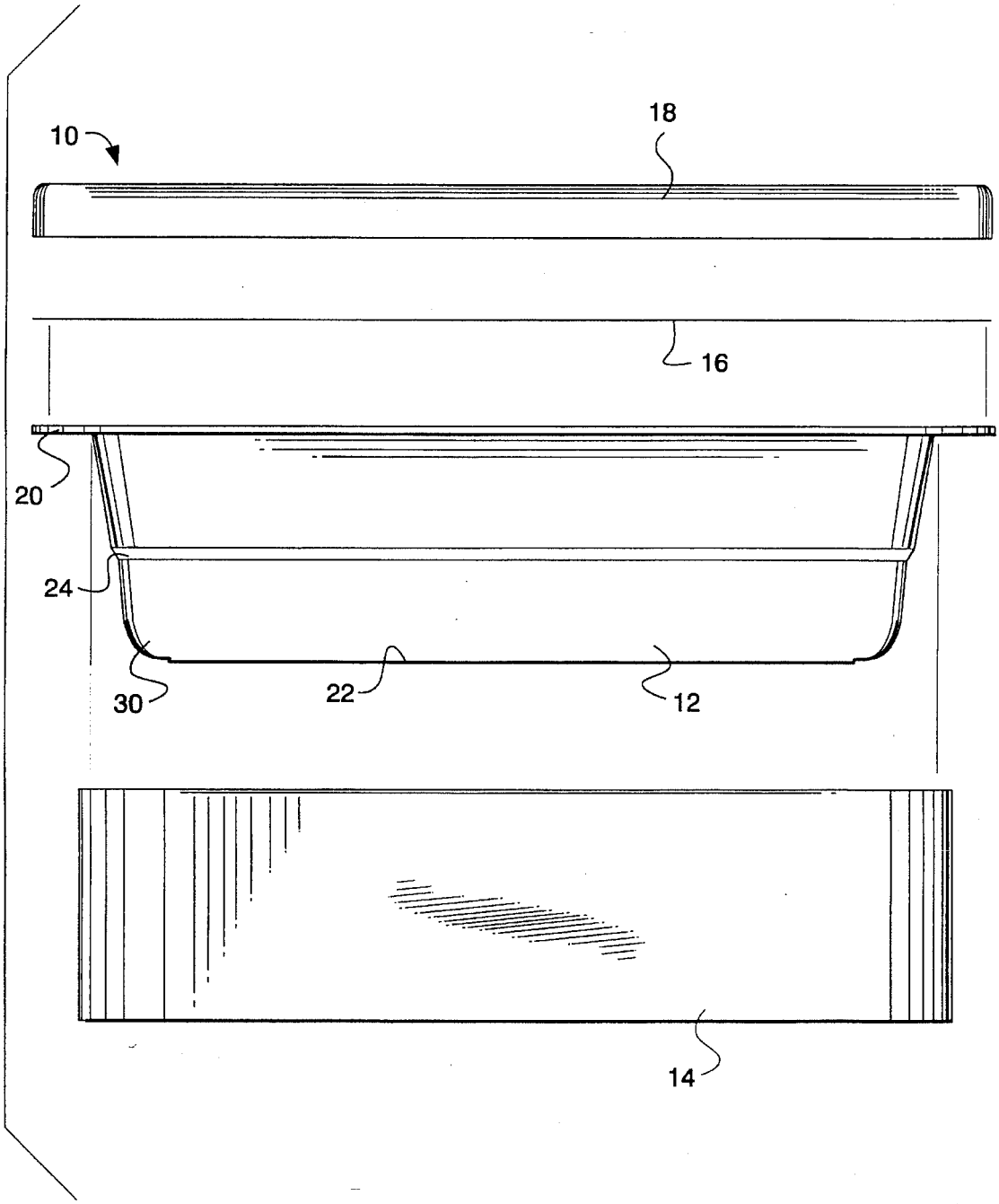
FIG. 8 is an exploded elevational view of the container assembly.

As those familiar with high volume production will appreciate, substantial advantages can be obtained with the type of assembly illustrated in FIG. 8, where the tub 12 is inserted within the outer housing 14. As mentioned above, housing 14 can carry coupons, tear-off recipes or the like, and when made of paperboard material can be economically produced using conventional printing techniques. Accordingly, a change in appearance of the container assembly is economically accomplished during printing of the paperboard housing. Further, attention can be focused on producing an economical plastic tub, without undue regard being given to its appearance, since it is in effect hidden by the outer housing 14. Also, if desired, the housing 14 can be removed to aid in recycling of tub 12.

It has been found advantageous to provide denesting lugs for the plastic tub to aid in the mass production and handling of the tub component of the packaging assembly. For example, the plastic tubs can be mass produced at a remote plastic molding facility and can be stored for future use, as required. As mentioned, the tub sidewall are made to be flexible, and since support for the container can be derived from the outer housing 14, the tub can be made of thin-gage materials. Although not required, it is desirable that the tub have a widened, diverging open end, and accordingly, tubs having these features can become wedged together when handled in bulk quantities.

Figure 10:
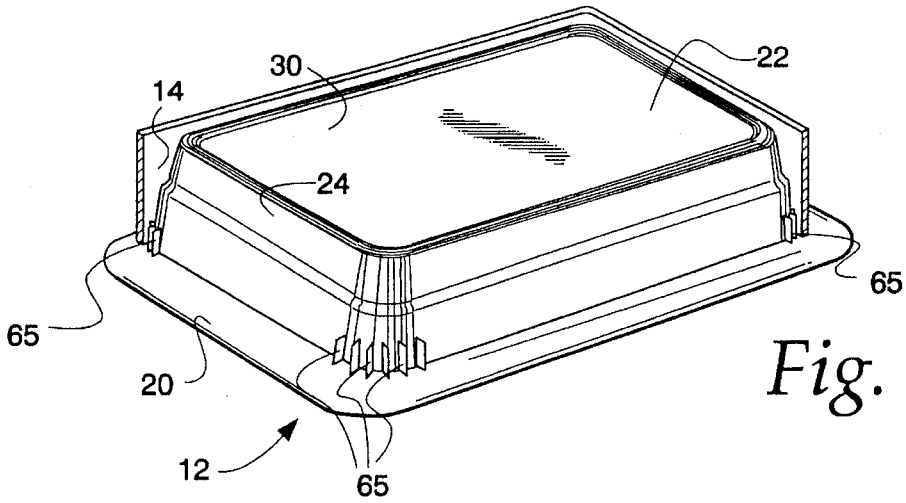
FIGS. 10 and 11 show tubs similar to that of FIG. 9, but having nesting lugs of different configurations.
Figure 11:
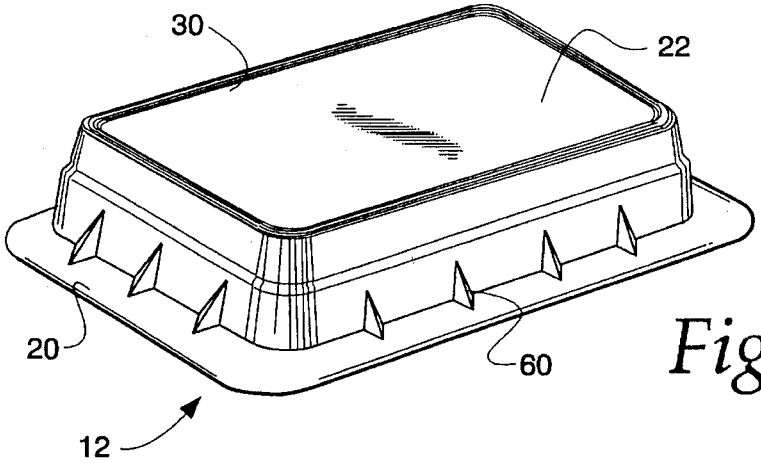
Figure 12:
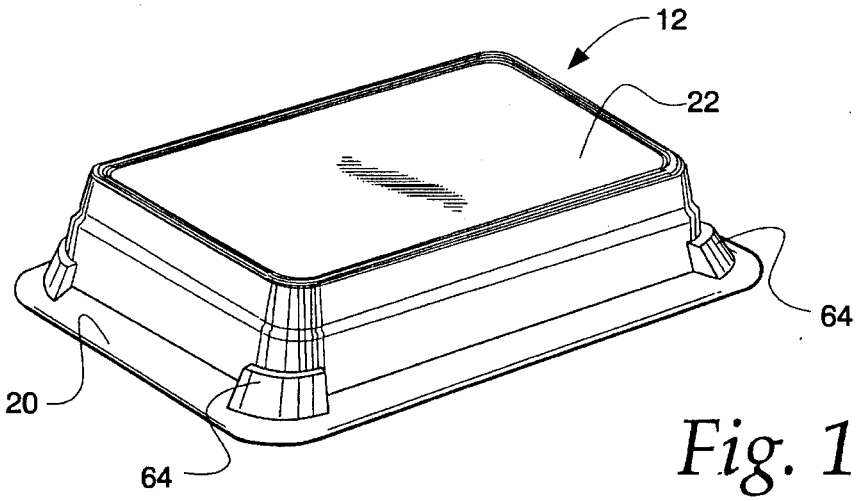
FIG. 12 is a perspective view of the plastic tub of FIG. 9.
Figure 9:
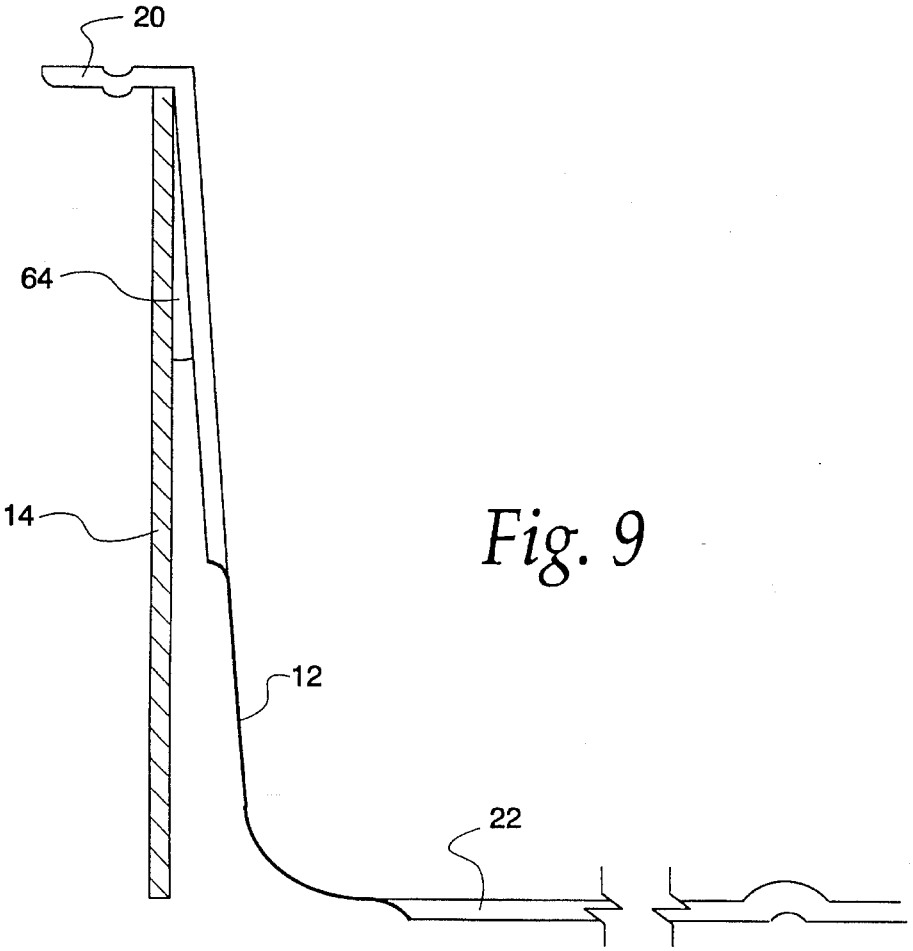
FIG. 9 is an enlarged cross-sectional view of a plastic tub of the type used above having denesting lugs integrally formed therewith.

Accordingly, the denesting lugs may be added to the tub, as illustrated in FIGS. 9–12. FIGS. 9 and 12 show denesting lugs 64 located at the corners of tub 12. It is generally preferred that the lugs 64 be small relative to the sidewall dimensions of the tub, although a continuous collar blending the lugs 64 together so as to form a continuous band adjacent flange 20 could be provided, if desired. The lugs 64 can be separately formed and secured to tub 12 with a suitable adhesive. However, it is preferable that lugs 64 be integrally formed with tub 12 during an integral molding process. The denesting lugs 64 at the corner offer a further advantage in relieving stress on flange 20 and accordingly, the flange 20 can be made thinner, if desired since forces pushing up on flange 20 by housing 14 are absorbed by the adhesive joinder of housing 14 with the outwardly directed face of lug 64. Although the top of housing 14 is shown butting against flange 20, the flange can be spaced from housing 14, if desired.

With reference to FIG. 10, a series of spaced-apart tab-like denesting lugs 65 are located at the corners of tub 12. As with the other configurations of denesting lugs, the lugs 65 are preferably located at the upper ends of the tub sidewalls, immediately adjacent flange 20.

FIG. 11 shows alternative denesting lugs 60 having a generally tetrahedral shape. As indicated in FIG. 11, the denesting lugs 60, as well as other types of denesting lugs which may be employed, may be spaced about the four sides of the plastic tub or on each corner, if desired. FIG. 12 shows rounded denesting lugs 64, located at the corners of the tub. In order to prevent hindrance of rolling action of the sidewall, it is desired that the denesting lugs be reduced in height, as illustrated in FIG. 12, away from that portion of the sidewall which is folded to form a rolling bend.

Figure 13A:
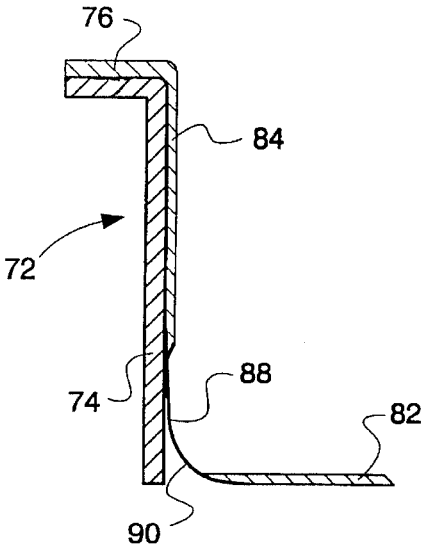
Figure 13B:
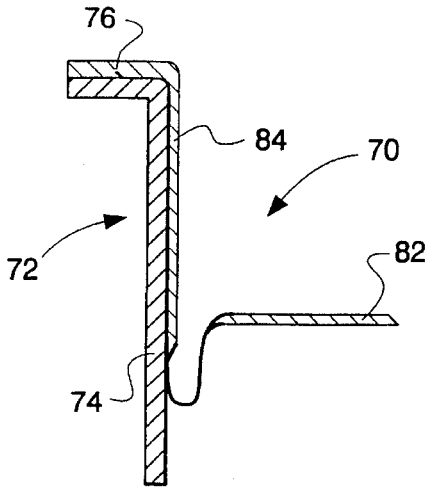

Referring now to FIGS. 13*a* and 13*b*, an alternative embodiment of the container assembly is generally indicated at 70. Included in the container assembly is an outer housing 72 preferably formed of paperboard material, preferably in the form of a collar 74. The plastic tub includes a bottom wall portion 82, a sidewall 84, and a plastic collar 76. A sidewall 84 of the tub is secured to collar 74 with a suitable adhesive. A lower portion 88 of the tub is unattached to collar 74 and is blended with bottom wall 82 at a rounded outside corner 90. The sidewall 84 of the plastic tub is flexible so as to allow bottom wall portion 82 to be pushed toward flange 76, as indicated in FIG. 13*b*. In the arrangement shown in FIGS. 13*a* and 13*b*, the tub sidewall 84 has a more localized area of bending, compared to the arrangement shown in FIGS. 7A–7C. The tub is preferably made of thin gage molded plastic material, with the collar 74 being relied upon to provide structural integrity for the package assembly.

FIGS. 14–16 show a further alternative embodiment of a carton assembly generally indicated at 92. A plastic tub preferably made of molding plastic material is generally indicated at 94, and includes a bottom wall 96 and a sidewall 98 meeting at a rounded outside corner 100. The tub sidewall 98 has an unfinished upper end 102, which is secured with a suitable adhesive 104 to flange 108 and to a housing wall 106, preferably made of paperboard material. A plastic flange 108 is joined to the upper end of housing 106 with a suitable adhesive. A relatively rigid bottom panel 110 underlies the tub bottom wall 96 and spreads the pushing force applied to the bottom of the container assembly more uniformly across the tub bottom wall 96. The tub wall 98 is preferably made of relatively thin gage plastic, so as to form a relatively small radius rolling bend, as indicated in FIG. 15. FIG. 16 shows a bottom view of the container assembly 92.

As indicated in FIG. 17, the reinforcing panel 110 could be located inside of the plastic tub if direct contact with the container contents does not pose a problem.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A container assembly, comprising:

a tub having a bottom wall and an upwardly diverging sidewall extending from the bottom wall so as to form an open top receptacle defining an interior volume for receiving contents;

the sidewall being upwardly and outwardly tapered and formed of flexible material so as to bend to form a rolling bend with portions of the tub sidewall overlapping one another and joined by a bend having a smooth curved cross section as the tub is turned inside-out with the bottom wall being passed through the tub interior to at least partially eject the contents;

an outer housing joined to an upper end of the tub sidewall, and enclosing the tub sidewall, with at least lower portions of the tub being spaced from the outer housing, so as to allow at least the lower end of tub sidewall to bend with the rolling bend within the housing; and a relatively stiff bottom panel joined to the bottom wall.

2. A container assembly, comprising:

a tub having a bottom wall and an upwardly diverging sidewall extending from the bottom wall so as to form an open top receptacle defining an interior volume for receiving contents;

the tub sidewall being upwardly and outwardly tapered and formed of flexible material so as to form a rolling bend with portions of the tub sidewall overlapping one another and joined by a bend having a smooth curved cross section as the tub is turned inside-out with the bottom wall being passed through the tub interior to at least partially eject the contents;

an outwardly extending flange at the upper end of the tub sidewall;

an outer housing joined to the tub adjacent the outwardly extending flange, the outer housing enclosing the tub sidewall, with at least lower portions of the tub being spaced from the outer housing, so as to allow at least the lower end of the tub sidewall to bend with the rolling bend within the housing;

a sealing film joined to said flange so as to enclose the interior volume of said tub;

a cover overlying said tub and mating to said flange with a snap-lock engagement; and a relatively stiff bottom panel joined to the bottom wall.

* * * * *